United States Patent [19]

Suominen

[11] 3,973,376

[45] Aug. 10, 1976

[54] APPARATUS FOR SUPPORTING AND OPENING PLASTIC BAGS

[76] Inventor: Heikki Samuli Suominen, Petsamonkatu 14, 33500 Tampere 50, Finland

[22] Filed: Mar. 11, 1974

[21] Appl. No.: 449,885

[30] Foreign Application Priority Data

May 2, 1973 Finland ..... 1379/73

[52] U.S. Cl. ..... 53/385; 53/390; 206/526; 206/806; 211/57; 229/53; 248/95

[51] Int. Cl.[2] ..... B65B 43/36; B65B 67/12

[58] Field of Search ..... 248/95, 100; 211/57, 211/59, 54; 206/526, 806; 229/53, 54 R; 53/188, 384, 385, 390; 93/93 HT, 28; 221/283, 191, 193

[56] References Cited

UNITED STATES PATENTS

| | | | |
|---|---|---|---|
| 2,069,266 | 2/1937 | Nicodemus | 53/385 |
| 2,790,591 | 4/1957 | Rosen | 53/384 X |
| 3,439,891 | 4/1969 | Pinto | 248/100 |
| 3,455,529 | 7/1969 | Propst et al. | 248/100 |
| 3,495,378 | 2/1970 | Kipers | 53/188 |
| 3,605,383 | 9/1971 | Piazze | 53/385 |
| 3,747,298 | 7/1973 | Lieberman | 53/390 |

*Primary Examiner*—James F. Coan
*Attorney, Agent, or Firm*—Pollock, Vande Sande & Priddy

[57] ABSTRACT

Apparatus for both supporting a plurality of plastic bags and for facilitating the automatic opening of the bags one at a time to permit the filling of each bag. Each of the bags is provided with generally aligned apertures in its front and back bag walls. Preferably the apertures are circular and with one of larger diameter than the other. A plurality of the bags is supported on an inclined rod having a diameter only slightly less than the aperture of smaller diameter in the opposed bag walls. At the dispensing end of the support rod a flange is provided which is of such size that the aperture of larger diameter in the opposed bag walls can quite readily pass over such flange, but the opposing bag wall is held by the flange and can be removed therefrom only by distorting and distending the smaller aperture. The plurality of bags on the rod is urged toward the flange by reason of the downward sloping inclination of the support rod. Air under pressure may be fed into the support rod and issued therefrom adjacent the flange, the resulting air jet facilitating the opening of the bag.

8 Claims, 6 Drawing Figures

APPARATUS FOR SUPPORTING AND OPENING PLASTIC BAGS

BACKGROUND OF THE INVENTION

The invention relates to apparatus for hanging a stack of plastic bags and for permitting the easy dispensing of bags from the stack one at a time so that each bag will readily be opened to permit filling it with goods such as groceries or similar items.

BRIEF DESCRIPTION OF THE PRIOR ART

It is known in the art to provide devices on which a plurality of bags can be hung through aligned apertures in the front and rear bag walls which may be provided either expressly for hanging the bags on a support or for carrying the bags such as when the apertures are of sufficient size to act as hand holds. It is known also to support such a track of bags on a shank member which is generally cylindrical in shape and generally conforming to the cross-section of the shank. It is also disclosed in the prior-filed co-pending application of Yrjo Suominen Ser. No. 262,899, filed June 14, 1972, and assigned to the assignee of the present application, to provide for aligned apertures in the front and back bag walls which are of different size, and with the opening or openings in the front wall about the same or somewhat larger than the diameter of the flange while the opening in the back wall is somewhat smaller than the flange so that the flange holds the bag onto the support means while filling the bag and opening of the bag is greatly facilitated by the fact that the front bag wall can readily slip over the flange. Removal of the bag from the support means can easily be accomplished nevertheless by pulling on the bag so as to distend the somewhat smaller aperture in the rear wall so that it can pass over the flange.

The front wall of the bag having the larger aperture can even more easily be removed from the support means by providing a means for inflating the bag with air, thereby readily removing the front bag wall from the flange so that the bag can easily be opened for filling. The apparatus of the aforesaid prior application, although highly advantageous over the prior art is nevertheless somewhat complicated in construction, thereby resulting in higher manufacturing costs, and is also susceptible to disturbances in operation, particularly with difficulty in causing the stack of bags to be continually urged toward the flange so that the bag nearest the flange will readily be capable of being opened as desired.

SUMMARY OF THE INVENTION

It is an object of this invention to provide an improvement over what is disclosed in the aforementioned application Ser. No. 262,899, such improvement comprising a mounting means for the flanged shank which permits such shank to be supported in a downwardly inclined position so that the force of gravity urges the stack of bags continually toward the flange. It is a further object to provide apparatus whereby a plurality of bag dispensing means may be arranged about a single supporting means. It is also an object of this invention to provide a support plate which is slidable about the inclined shank and provides a supporting surface for a stack of bags. The support plate is urged outwardly toward the flange on the shank and therefore aids in urging the stack of bags outwardly toward the flange so that they can more readily be dispensed.

DETAILED DESCRIPTION OF THE PREFERRED EMBODIMENTS

Figure 1:
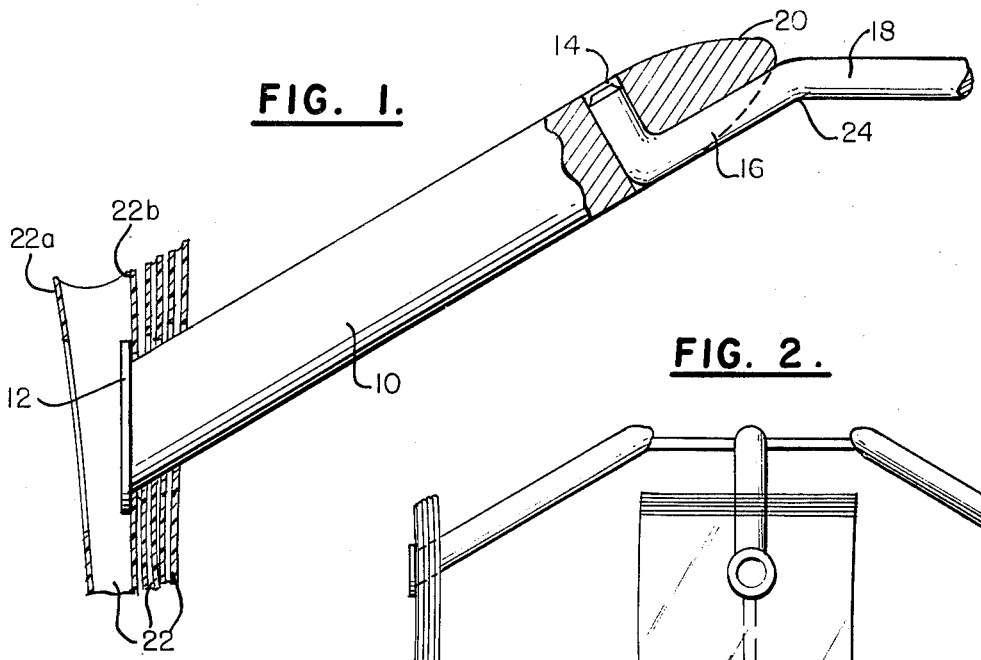
FIG. 1 illustrates an embodiment of the invention illustrating the inclined shank for supporting a stack of bags.

FIG. 1 illustrates a shank 10 which is preferably of circular cross-section and having a flange 12 at its lower, free end which is of somewhat larger diameter than the diameter of the main shank portion. The opposite end of the shank defines therein a transverse bore 14 which communicates with a longitudinal bore 16 extending along the bottom of the shank, both said bores 14 and 16 having a configuration such as to receive the L-shaped end of a support rod 18 which may be fastened at its right-hand end to a fixed part of the bag dispensing apparatus.

It will be apparent that the shank 10 can readily be removed from the support rod 18, and the right hand end of the shank which is preferably tapered as shown at 20 can then readily be inserted through the aligned apertures provided in the respective front and back walls **22*a* and 22*b* in each of the bags 22 in the stack of bags. Once the stack of bags has been placed on the shank, the shank can then be replaced on the support rod 18**.

It will further be noted that the support rod 18 is bent at 24 to provide for a downward inclination of the shank 10 thereby ensuring that the force of gravity will cause the stack of bags 22 to move downwardly along the shank and be urged against the flange 12. As described in the aforementioned application Ser. No. 262,899, each front bag wall **22*a* has a diameter somewhat larger than that of flange 12 so that the front bag wall will readily slip over the flange as shown in FIG. 1. On the other hand, the aligned aperture in the rear bag wall 22*b* is of a size somewhat smaller than flange 12 so it can be moved over flange 12 only by pulling on the bag and distorting and distending the aperture so that the bag can be removed from the support means. Of course, while the bag is in the position where it is retained by its rear wall but with its front wall free of the flange 12**, the bag is effectively opened thereby so that articles such as groceries or the like may readily be inserted therein.

The downward inclination of the shank 10 has been found to be very helpful in ensuring that the topmost bag in the stack will be urged against the flange 12 so that the bags can readily be dispensed one at a time.

Figure 2:
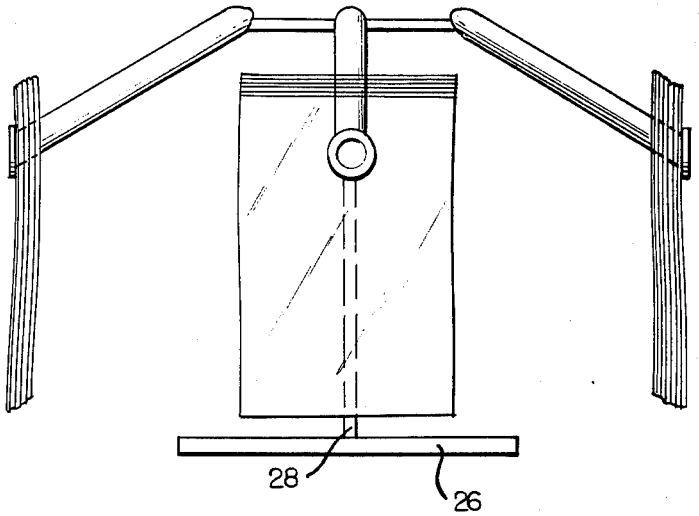
FIGS. 2 and 3 illustrate in plan and top views an arrangement whereby a plurality of inclined shanks is provided, each supporting a different stack of bags.
Figure 3:
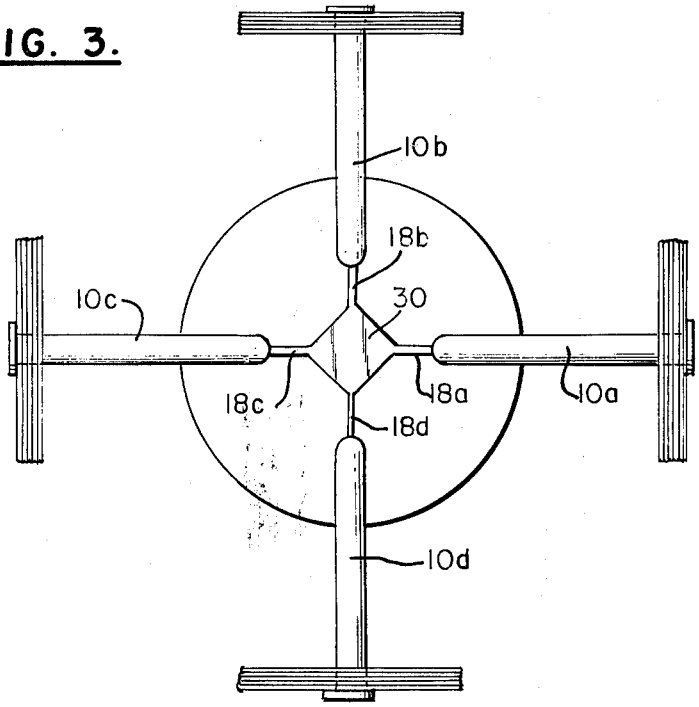

FIGS. 2 and 3 show how a plurality of means of the type illustrated in FIG. 1 may be provided at a common location. Thus, a support base 26 has mounted thereon a vertical support rod 28 which carries at its upper end a support plate 30 having connected thereto a plurality of rods 18*a*–18*d*, each comparable to the rod 18 of FIG. 1. An inclined shank 10*a*–10*d* is supported by each of these 18*a*–18*d*, also similar to the manner shown in FIG. 1. It will be apparent that a plurality of stacks of bags can thus be supported from a single dispensing means.

Figure 4:
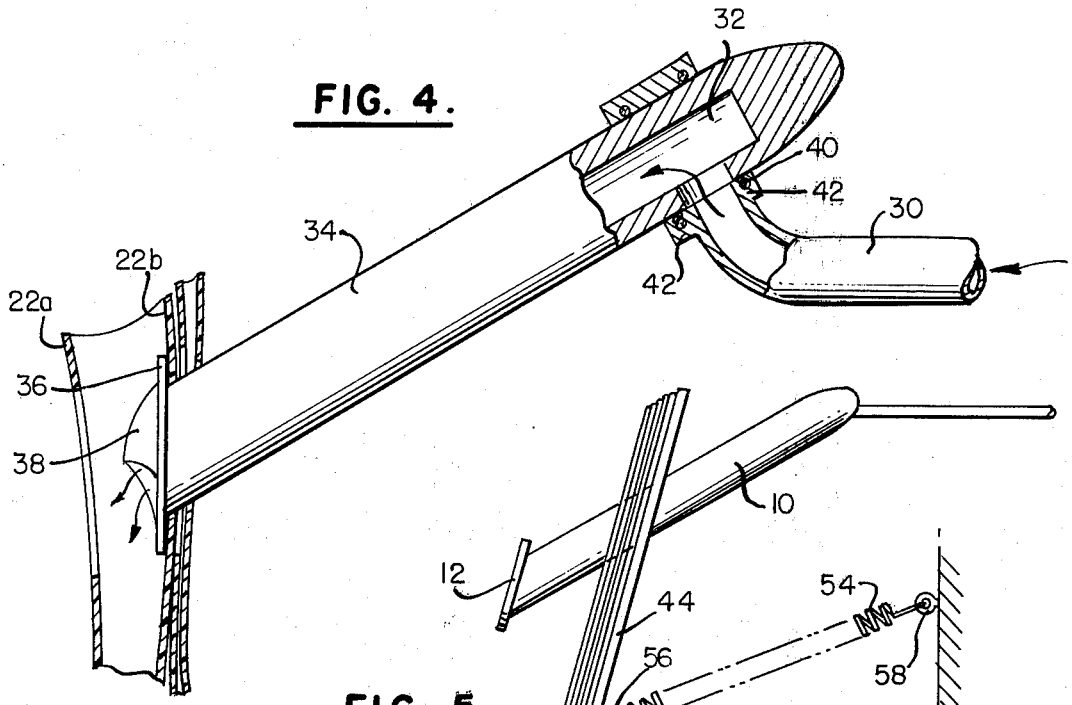
FIG. 4 illustrates an alternative embodiment of the apparatus of FIG. 1 particularly providing for the discharge of air out of the shank adjacent the flange.

FIG. 4 illustrates an alternative embodiment of the apparatus shown in FIG. 1. According to this embodiment, the support rod 30 is hollow so that air may be passed therethrough. The hollow interior of support rod 30 communicates with a longitudinal bore 32 in shank 34. Air passing through the bore 32 issues from the lower end of the shank adjacent the flange 36, a nozzle 38 being provided for this purpose and being so configured that the air discharging therefrom will be expelled into the partially open bag 22 to fully open the bag and thereby facilitate the insertion of goods therein. In this embodiment, the shank 34 is frictionally engaged by being inserted into a mating aperture 40 provided at the end of support rod 30, two resilient members 42 such as packing members being provided to bear frictionally against the shank 34 and hold it securely in place within aperture 42 although still permitting ready removal of the shank 34 therefrom so that a new stack of bags can be positioned about the shank.

Figure 5:
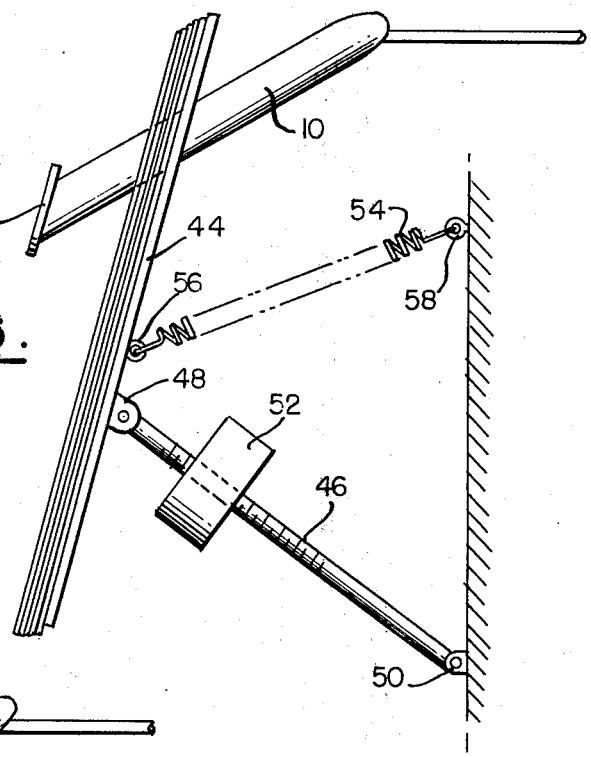
FIG. 5 illustrates a further embodiment of apparatus including a flat support plate for a stack of bags.

In the embodiment of FIG. 5, a supporting plate 44 is provided which pushes a stack of bags toward the free end of the shank 10. The plate 44, it will be noted, is so positioned that it lies substantially parallel to flange 12, i.e. with the lower edge of plate 44 being advanced forwardly of its upper edge. A single connecting arm 46 is shown in FIG. 5, but it will readily be understood that two such laterally spaced arms may equally well be employed. Each such arm 46 is hingedly connected at 48 to plate 44 and is also hingedly connected to a fixed support at hinge 50. A weight member 52 is provided which is movable along rod 46 to adjust the amount of pressure exerted by plate 44 against a stack of bags. Threaded engagement may be provided between member 52 and rod 46 so as to permit close adjustment of the effect provided by member 52. Under the influence of gravity, plate 44 is urged in a forward direction toward the flange 12, and weight 52 can be adjusted in position to regulate the pushing effect of the plate 44 against the stack of bags. If desired, a tension spring 54 may be connected between a support point 56 on plate 44 and a further fixed support means 58 so that the concurrent actions of the spring 54 and the weight 52 will maintain the pushing power of the plate against the stack of bags substantially constant independent of the thickness of the stack. It will be understood, of course, that a bore is provided in plate 44 of sufficient size to enable it to pass readily along the shank 10 without binding. Plate 14 can be made of plastic, wood, or metal or also of a metal wire grating.

Figure 6:
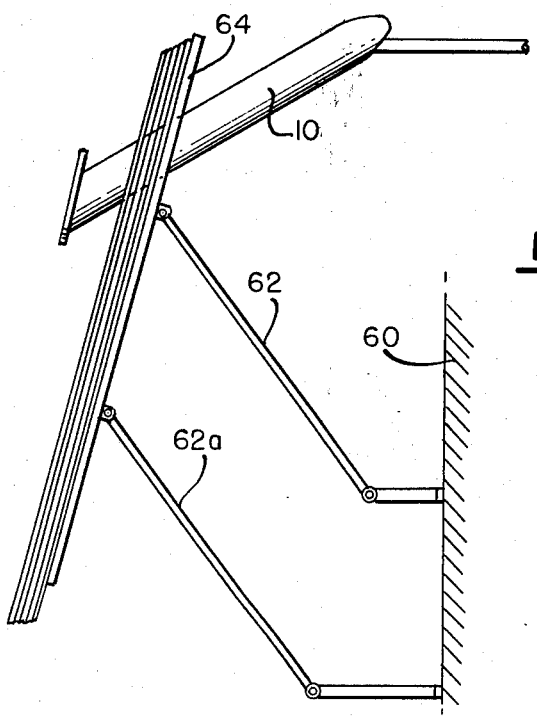
FIG. 6 illustrates still another embodiment comprising a modification of that shown in FIG. 5.

FIG. 5 illustrates still another embodiment of the invention wherein the plate is supported by a fixed frame or other support 60 by means of parallel supporting arms of pairs of arms 62, 62*a*. The parallelogram linkage thus provided maintains the plate 64 always parallel to itself irrespective of its position along the shank 10. It should be understood that a weight such as the weight 52 of FIG. 5 may be employed in connection with the embodiment of FIG. 6 and that it is also feasible to use a spring comparable to the spring 54 shown in FIG. 5.

I claim:

1. Apparatus for the dispensing of bags formed of a flexible plastic material from a stack of such bags, each bag having aligned apertures in its opposing side walls and with one of said apertures being larger than the other, said apparatus comprising a shank whose cross-sectional dimensions are less than that of the smaller bag aperture so that a stack of said bags is easily slideable along said shank, a rigid circumferential flange at one end of said shank whose cross-sectional dimensions is slightly less than that of the larger bag aperture but larger than the smaller bag aperture, and mounting means for the other end of said shank for supporting said shank in a downwardly inclined position with said flanged end lower, the downward inclination of said shank being sufficient to ensure that the stack of bags is urged downwardly to abut said flange, said shank being detachably supported on said mounting means.

2. The apparatus of claim 1 wherein said shank defines a longitudinal bore and also supports a nozzle at its flanged end, and means for feeding air under pressure into said bore.

3. The apparatus of claim 1 which further includes a support stand for detachably supporting a plurality of said shanks.

4. The apparatus of claim 1 which further includes a rigid plate which is slideable along said shank, and means for urging said plate toward the flanged end of said shank.

5. The apparatus of claim 4 wherein said means for urging said plate maintains said plate parallel to said flange.

6. The apparatus of claim 5 wherein said means for urging said plate includes a weight member and means for adjusting the effect of said member in urging said plate toward said flanged end of said shank.

7. The apparatus of claim 6 which further includes spring means acting in opposition to the effect of said weight member.

8. The apparatus of claim 5 wherein said means for urging said plate includes a parallogram linkage.

* * * * *